US005787963A

United States Patent [19]

Tsuji et al.

[11] Patent Number: 5,787,963

[45] Date of Patent: Aug. 4, 1998

[54] SQUEEZE PIN CONTROL SYSTEM IN DIE CASTING MACHINE

[75] Inventors: Makoto Tsuji, Zama; Norihiro Iwamoto, Sagamihara, both of Japan

[73] Assignee: Toshiba Kikai Kabushiki Kaisha, Tokyo-To, Japan

[21] Appl. No.: 771,145

[22] Filed: Dec. 20, 1996

[30] Foreign Application Priority Data

Dec. 22, 1995 [JP] Japan ..... 7-335299

[51] Int. Cl.[6] ..... B22D 27/11

[52] U.S. Cl. ..... 164/120; 164/321

[58] Field of Search ..... 164/113, 120, 164/312, 319, 320, 321

[56] References Cited

U.S. PATENT DOCUMENTS 5,161,598 11/1992 Iwamoto et al. ..... 164/120

5,555,924 9/1996 Iwamoto et al. ..... 164/319

*Primary Examiner*—Kuang Y. Lin

*Attorney, Agent, or Firm*—Cushman Darby & Cushman IP Group of Pillsbury Madison & Sutro LLP

[57] ABSTRACT

A method of precisely controlling the stroke of movement of at least one squeeze pin in a die casting machine, which pressurizes locally the molten metal charged into a cavity of a metal mold. The method comprises detecting a flow rate of the pressure oil at the back pressure side of a squeeze pin cylinder which drives the squeeze pin of the die casting machine, calculating the stroke of the squeeze pin on the basis of the detected flow rate, and controlling the stroke of the squeeze pin toward a target value with the detected flow rate as a parameter.

4 Claims, 2 Drawing Sheets

SQUEEZE PIN CONTROL SYSTEM IN DIE CASTING MACHINE

BACKGROUND OF THE INVENTION

1. Field of the Invention

The present invention relates to a system of controlling a squeeze pin in a die casting machine, in which molten metal charged into a cavity of a metal mold of the die casting machine is locally pressurized by the squeeze pin.

2. Description of the Prior Art

In general die casting, when the molten metal, after being charged into the cavity of the metal mold, is cooled and solidified, "an inward shrinkage cavity" is apt to be easily produced in the structure of the cast products due to the shrinkage in volume. Further, since the molten metal is injected into the cavity of the metal mold at high speed, air is drawn into the molten metal, thereby resulting in the production of blowholes inside the cast products. In order to eliminate defects such as inward shrinkage cavities, blowholes and the like, prevention of the production of such shrinkage blowholes has been performed by pressing a squeeze pin into the molten metal to locally pressurize it immediately before the molten metal within the cavity of the metal mold is solidified.

In the practice of such a method of local pressurization using the squeeze pin, it is important to decide an appropriate pressure and an appropriate timing in pressurization according to casting conditions. The prior arts regarding the control of such a kind of squeeze pin are disclosed, for example, in Japan Patent Publication No. 156560/1984, Japan Patent Laid-open Publication No. 9758/1983 and Japan Patent Laid-open Publication No. 118167/1992.

The squeeze pin control in Japan Patent Publication No. 156560/1984 is performed by controlling the timing at which the squeeze pin is pressed into the cavity, to a constant value using a timer. Further, in the method disclosed in Japan Patent Laid-open Publication No. 9758/1983, the temperature of the metal mold is detected by means of a sensor, and the motion of the squeeze pin is controlled on the basis of the detected temperature. In Japan Patent Laid-open Publication No. 118167/1992, a method of controlling a pressurization pin is proposed which comprises detecting the stroke of the squeeze pin, and controlling the timing at which the squeeze pin is advanced into the cavity, so that the detected value comes to a predetermined stroke, thereby pressurizing the molten metal under an appropriate condition.

However, since, in the prior art described in the above-mentioned Japan Patent Publication No. 156560/1984, the temperature of the metal mold at the time when the casting begins and the temperature of the solidification of the molten metal at the time when the metal mold has become stable are different, scatter often occurs in the quality of the cast products even when the timing at the time when the squeeze pin begins to advance is controlled. In the prior art described in Japan Patent Laid-open Publication No. 9758/1983, there is a problem in that if a relationship in timing between the temperature of the metal mold or the temperature of the molten metal and the timing in pressurization is not precise, it is difficult to control the motion of the squeeze pin and, also when the temperature of the metal mold is controlled, it is difficult to construct a relationship between the temperature of the molten metal and the injection pressure constant.

Moreover, in the squeeze pin controlling method described in Japan Patent Laid-open Publication No. 118167/1992, there is a merit of making it possible to directly measure the position of the squeeze pin and, on the other hand, it is necessary to attach a sensor to each metal mold and set an optimum stroke of the squeeze pin in advance for each squeeze pin so as to correspond to the metal mold and the casting conditions. For this reason, there is a problem in that, in the case where the stroke of the squeeze pin has been set erroneously, the squeeze pin is controlled with such erroneously set value.

Accordingly, the applicant of this case proposed a technique for solving the above-described problems in previously filed Japanese Patent application No. 262787/1994, in which the stroke of the squeeze pin is controlled so as to come to the target value, with the pressure and flow rate of the pressure oil supplied to a squeeze pin cylinder which moves the squeeze pin, and with a waiting time from the time when a charge of the molten metal has been completed to the time when the squeeze pin starts to advance into the cavity as parameters.

However, the above-described proposed arts have technical problems as described below.

First, since a flow rate detector for detecting the position of the squeeze pin depending on a flow rate of the pressure oil supplied to the squeeze pin cylinder is provided in a hydraulic circuit at the inlet side of the squeeze pin cylinder, if air is mixed into between a change-over valve in the hydraulic circuit and the squeeze pin cylinder, the compression of air or the expansion of a rubber hose due to the pressure oil causes an error in the measurement of flow rate, which is reflected in the result of the calculation of the stroke of the squeeze pin and, consequently, makes it difficult to apply the correct pressurizing force to the squeeze pin.

Further, in the method of controlling the position of the squeeze pin cylinder in the prior art, possible occurrence of the leakage of the hydraulic oil from said squeeze pin cylinder is not taken into consideration and, accordingly, an amount of the leakage is also detected in the measurement of flow rate, so that the stroke which is greater than the distance actually traveled by the squeeze pin is calculated, thus causing an error in the positioning of the squeeze pin.

Moreover, in the case where the pressure and flow rate of the pressure oil supplied to the squeeze pin cylinder, and the waiting time from when a charge of the molten metal is completed to when the squeeze pin starts to advance are controlled as parameters, if the pressure and flow rate of the pressure oil supplied to the squeeze pin cylinder, and the waiting time from when charge of the molten metal is completed to when the squeeze pin starts to advance are each independently corrected as parameters, there is a case of correction being impossible, for example, even when an increase in pressure is made up to the upper limited value, the target value is not reached.

SUMMARY OF THE INVENTION

An object of the invention is to provide a system which, while measuring indirectly the stroke of at least one squeeze pin, detects the stroke of the squeeze pin so that an error in position arising from air and the like in a hydraulic circuit is not caused, thereby allowing the stroke of the squeeze pin to be controlled exactly.

Another object of the invention is to provide a control method of controlling the stroke of the squeeze pin exactly by eliminating an error arising from an amount of leakage of the pressure oil in the squeeze pin cylinder.

A further object of the invention is to provide a control method in which the parameters for control are appropriately corrected to control the stroke of the squeeze pin toward the target value.

In order to achieve the above-mentioned object, according to the present invention, there is provided a device for controlling at least one squeeze pin in a die casting machine, in which molten metal charged into a cavity of a metal mold is locally pressurized by said squeeze pin, which comprises:

a squeeze pin cylinder for driving said squeeze pin;

a squeeze pin hydraulic controlling circuit which is connected to said squeeze pin cylinder and which controls the pressure and flow rate of pressure oil supplied to said squeeze pin cylinder; and a flow rate detector which is connected to the back pressure side of said squeeze pin cylinder and which detects the flow rate of pressure oil supplied to said squeeze pin cylinder.

According to the present invention, since the flow rate detector exists at the back pressure side of the squeeze pin cylinder, a measurement in the flow rate is performed on the return side under no pressure to a tank, thereby allowing the error in the detection of the flow rate arising from expansion of the hose, compression of the air and the like to be eliminated.

Further, in order to solve the above-described problem, there is provided a method of controlling at least one squeeze pin in a die casting machine, in which molten metal charged into a cavity of a metal mold is locally pressurized by said squeeze pin, which comprises:

detecting a flow rate of pressure oil at the back pressure side of said squeeze pin cylinder for driving said squeeze pin;

calculating a stroke of said squeeze pin on the basis of said detected flow rate; and controlling the stroke of said squeeze pin to a target value with said detected flow rate as a parameter.

The present invention allows the stroke of the squeeze pin to be calculated in a highly accurate way on the basis of the precisely detected flow rate, and further allows the stroke of the squeeze pin to be surely controlled toward a target value.

Moreover, in order to solve the above-described problem, there is provided a method of controlling said squeeze pin as claimed in claim 2, comprising detecting an amount of leakage of said pressure oil in said squeeze pin cylinder, subtracting said amount of leakage of said pressure oil from said detected flow rate, and calculating the stroke of said squeeze pin on the basis of the flow rate after said amount of leakage is subtracted.

According to the present invention, an amount of the inner leakage, which actually occurs at the time of the pressurizing motion of the squeeze pin cylinder, is included in the detected value and, accordingly, the stroke of the squeeze pin can be detected more strictly.

Further, in order to solve the above-described problem, there is provided a method of controlling said squeeze pin as claimed in claim 2, further comprising:

adding, to said flow rate, a pressure of the oil pressure supplied to said squeeze pin cylinder and a waiting time from the time when a charge of molten metal is completed to the time when said squeeze pin starts to advance, as each of the parameters which control the stroke of said squeeze pin toward a target value, setting a preference order of each of said parameters which comprises said flow rate, pressure and waiting time, and correcting said each of the parameters in order according to said preference order until the stroke of said squeeze pin comes to a target value.

The present invention copes effectively with and solves a situation, for example, a limit of correction in which the stroke of the squeeze pin does not reach a target value even under the maximum pressure, and another situation of the corrected result of the parameter being unstable, thereby enabling the stroke to be surely controlled toward a target value.

BRIEF DESCRIPTION OF THE DRAWINGS

Other objects and aspects of the invention will become apparent from the following description of an embodiment with reference to the accompanying drawings in which.

PREFERRED EMBODIMENT OF THE INVENTION

One embodiment of the present invention will now be explained with reference to the accompanying drawings.

Figure 1:
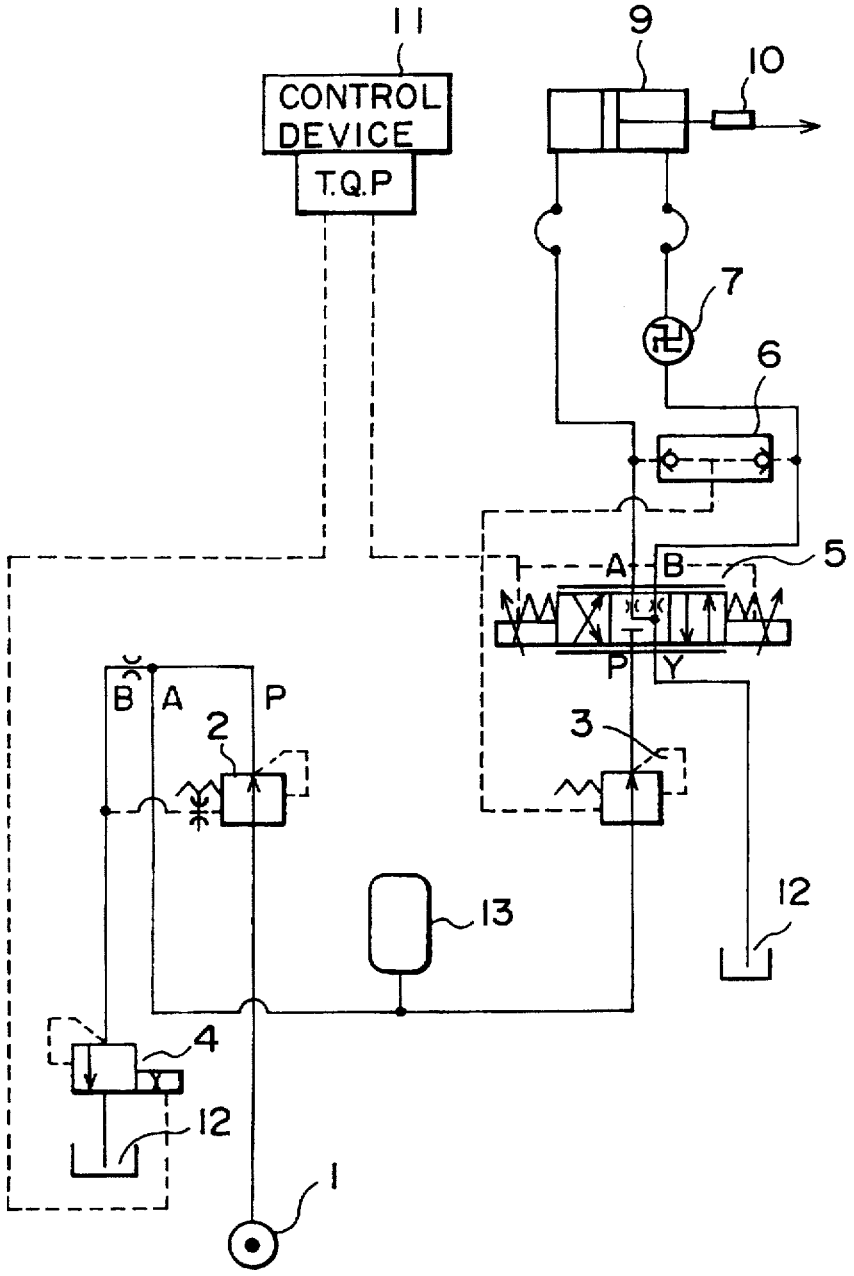
FIG. 1 is a circuit diagram of a hydraulic circuit for carrying out the present invention by moving a squeeze pin in a die casting machine.

Referring to FIG. 1 showing a hydraulic circuit applied to the present invention, reference character 1 indicates a hydraulic pressure supply source, which comprises a hydraulic pump, a motor, a filter, a tank and others (not shown). The pressure oil supplied from the hydraulic pressure supply source 1 is further pressurized by an accumulator 13. Further, the hydraulic circuit which actuates the squeeze pin 10 comprises a pressure regulating valve 2 which regulates the pressure of the working oil from the hydraulic pressure supply source 1, a pressure compensating valve 3, a proportional electromagnetic relief valve 4, a proportional electromagnetic directional flow rate controlling valve 5 which regulates a flow rate of the working oil, a shuttle valve 6 actuated by a signal from the pressure compensating valve 3, a flow rate counter 7 which counts the flow rate of the working oil passing through the proportional electromagnetic directional flow rate controlling valve 5 in a predetermined unit, a squeeze pin cylinder 9 which performs the forward and backward motion of the squeeze pin 10 connected to the proportional electromagnetic directional flow rate controlling valve 5, and a control device 11 which controls the position of the squeeze pin 10 and which controls the time at which the squeeze pin cylinder 9 starts to advance and the time during which it is being moved.

The control device 11 functions, in the traveling motion (lubricating motion) of the squeeze pin 10 carried out before molten metal is charged into the cavity of the metal mold, to measure the stroke S of the squeeze pin 10 under the condition of unloading, and set $(S-\alpha)$ obtained by subtracting a predetermined small value $\alpha$ at a position slightly before the measured stroke S of the squeeze pin 10, from the stroke S, as an optimum stroke of the squeeze pin 10 in the casting cycle.

Moreover, as already explained in detail in the specification regarding Japanese Patent application No. 262787/

1994, the control device 11 functions to compare a detected value of the stroke of the squeeze pin 10 with a value of the set stroke (S−α), to correct the values of parameters, which determine the actual stroke of the squeeze pin, such as the pressure and flow rate of the pressure oil supplied to the squeeze pin cylinder or a waiting time from a time when a charge of the molten metal is completed to a time when the squeeze pin 10 is advanced, so that the stroke of the squeeze pin 10 comes to the set stroke (S−α), and to control the position of the squeeze pin 10 on the basis of such corrected value.

Further, a procedure of actuating the squeeze pin 10 of a die casting machine will be described.

First, when molten metal is poured into an injection sleeve (not shown) and injected, it is charged into the cavity of the metal mold. At that time, a rise in pressure within the injection cylinder (not shown) occurs, and is detected by means of the pressure compensating valve 2, and the detected signal is transmitted to the control device 11, which in turn controls the proportional electromagnetic directional flow rate controlling valve 5 and the proportional electromagnetic relief valve 4 on the basis of the waiting time T, flow rate Q and pressure P which are previously set.

The stroke (position) of the squeeze pin 10 can be controlled by controlling the flow rate Q and the pressure P each independently or mutually. If the pressure of the squeeze pin 10 exceeds an appropriate value, the flow rate Q, pressure P and waiting time T are controlled on the basis of the previously prepared program data.

The technical effects in selecting the flow rate Q, pressure P and waiting time T as parameters are described below.

The flow rate Q greatly effects the reduction or removal of blowholes positioned away from the position where the squeeze pin 10 presses. The pressure P exerts an influence on the cracking of the products. The motion timing of molten metal being pressed by the squeeze pin 10, i.e., the waiting time T exerts influence on the density of all of the cast products. In this connection, in the positional control of the squeeze pin 10, the flow rate of the working oil passing through the proportional electromagnetic directional flow rate controlling valve 5 is indirectly measured in position by means of the flow rate counter 7 which counts the flow rate in a predetermined unit. This flow rate counter 7 is incorporated into a hydraulic line through which the oil within the cylinder chamber at the rod side (back pressure side) of the squeeze pin cylinder 9 is returned to the tank. Accordingly, no pressure is applied to the hydraulic line in which the flow rate counter 7 is provided, so that any error in measurement of the flow rate arising from the mixing of air, expansion of the rubber hose and the like can be eliminated.

When the plunger tip of an injection cylinder (not shown) pushes a limit switch for a high speed injection, the squeeze pin 10 is actuated after a time period of timer T1 has elapsed at the point when the pressure regulating valve 2 and the pressure compensating valve 3 reach the set pressure. After the timer T1 has elapsed, the proportional electromagnetic directional flow rate controlling valve 5 supplies the pressure oil to the squeeze pin cylinder 9 by way of the pressure compensating valve 3 and controls the flow rate Q finely, performing the squeezing operation by the squeeze pin 10 in the cast product. A counted value of the flow rate by the flow counter 7 at that time is proportional to the stroke of the squeeze pin 10 and, accordingly, if a relationship between the counted value and the stroke of the squeeze pin 10 is previously measured, the stroke of the squeeze pin 10 which has been pushed immediately before solidification can be indirectly calculated from the above-described counted value.

Further, the squeeze pin 10 stops at the position (S−α) where a stroke value at the time of squeeze casting is smaller than the full stroke value S. After the elapsing of a holding time of the squeeze pin and when the proportional electromagnetic directional flow rate controlling valve 5 is not excited, the squeeze pin cylinder 9 is restored to the advanced condition and waits the commencement of the next injection.

Since, at this time, the proportional electromagnetic directional flow rate controlling valve 5 is in a neutral position, the pressure oil cannot pass through it and flows into the accumulator 13, in which a pressure is accumulated. Excess pressure oil is collected into the tank 12 by way of the proportional electromagnetic directional flow rate controlling valve 5.

Moreover, in the squeeze pin 10, the stroke value Sf actually detected using the flow rate counter 7 is monitored and compared with the set stroke value (S−α) of the squeeze pin 10. If the detected stroke value Sf deviates from the permitted limit, the correction of the parameters is performed on the basis of the previously set preference order of the waiting time T, flow rate Q and pressure P, as described later, and the learning control is made so that the detected value Sf exists within the permitted values.

From the next casting cycle, the hydraulic control circuit for the squeeze pin is operated on the basis of the corrected parameters, and the stroke of the squeeze pin 10 is controlled so as to come into the prescribed set value.

The motion of the squeeze pin 10 is classified roughly into two; one being the lubricating motion of the squeeze pin 10 and the other being the squeezing motion of molten metal. The former is an unloading operation and the latter is a loading operation. In the unloading operation, no leakage of the pressure oil exists within the squeeze pin cylinder 9 and, accordingly, the exact positioning is possible; however, in the loading operation, a leakage of the pressure oil within the squeeze pin cylinder 9 exerts an great influence on the accuracy in positioning.

Namely, in the case where the control of position of the squeeze pin cylinder 9 which moves the squeeze pin 10 is performed for the molten metal during solidification supplied into the metal mold, if the pressure oil leaks within the squeeze pin cylinder 9, an amount of the leakage is counted and an amount of movement of the squeeze pin 10 more than the actual amount of movement thereof is calculated, however, this error is corrected in the way as described below.

Figure 2:
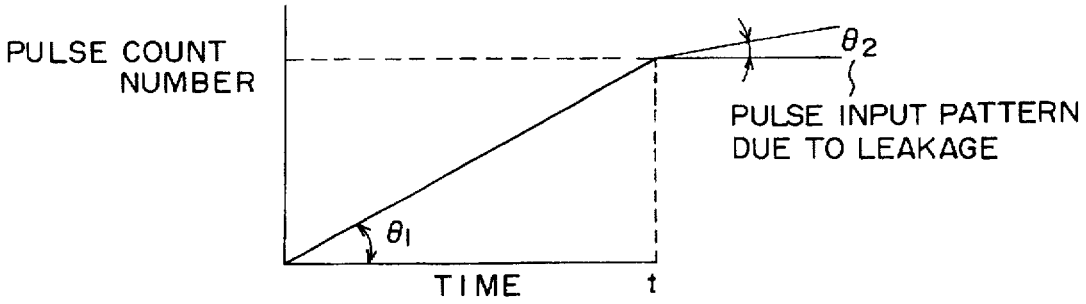
FIG. 2 is a view showing a pulse count pattern of a flow rate counter when the squeeze pin is moved in lubricating motion.

Hereupon, FIG. 2 shows a relationship between the time and the input pulse from the flow rate counter 7 corresponding to the stroke of the squeeze pin cylinder 9 at the time of the lubricating motion (at the time of unloading motion) of the squeeze pin 10. Since the squeeze pin 10 moves in the condition of unloading at the time of the lubricating motion, no leakage of the pressure oil occurs within the squeeze pin cylinder 9. In this case, an increase in the number of pulse count per unit of time shifts rectilinearly with an inclination of an angle of θ1 up to the time t of the stroke end.

In the meantime, when the squeeze pin 10 reaches the stroke end, the squeeze pin 10 comes to a squeezing motion. Since an inner leakage of the pressure oil occurs within the squeeze pin cylinder 9, a pulse counting operation is performed corresponding to such amount of the leakage. If the amount of the leakage is assumed to be constant, a pattern of pulse count shifts rectilinearly at an angle of θ2 (θ2<θ1). Namely, since the movement of the squeeze pin 10 is stopped originally, any pulse counting operation by the flow rate counter 7 cannot be caused, however, a pulse counting operation due to a leakage of the pressure oil is performed in the flow rate counter 7 and, consequently, a judgement is made as if the squeeze pin 10 has moved further.

Figure 3:
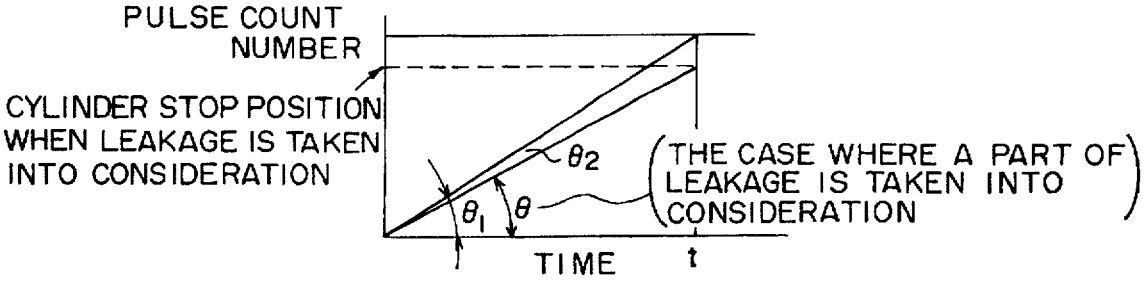
FIG. 3 is a view showing a pulse count pattern of a flow rate counter when the squeeze pin is moved in molten metal squeezing motion.

FIG. 3 is a diagram showing a change in time of the count number of the input pulse from the flow rate counter 7 in the molten metal squeezing motion which is an actual motion of the squeeze pin 10 after the lubricating motion. In this molten metal squeezing motion, as a load is applied from the start, the inner leakage of the pressure oil occurs in the squeeze pin cylinder 9. The count number of pulse detected by the flow rate counter 7 shifts in a straight line with an inclination of an angle of $\theta 1$ to the stroke end. This includes the inner leakage and is the total of the pulse count number corresponding to the inner leakage portion and the pulse count number corresponding to the portion required for the actual action. That is, the pulse count number corresponding to the actual movement of the squeeze pin 10 is obtained by subtracting the inner leakage portion from the above-described sum total of the pulse count number. If the amount of leakage under a load is considered to be the same as that in the case of FIG. 2, the straight line expressed by an inclination of $$\theta=\theta 1-\theta 2$$

is a pulse count pattern corresponding to the pressurized actual motion of the squeeze pin 10.

Therefore, the pulse count pattern detected from the time of start to the time of stop at the time of the molten metal squeezing motion is corrected, with $$0\leqq\theta 2<\theta 1$$

as a condition, to the pulse count pattern expressed by an angle of $\theta$ taking the amount of the inner leakage in the squeeze cylinder 9 into consideration using the above-described method and, then, by multiplying the corrected value by the time t, the obtained value agreeing with the actual motion stroke of the squeeze pin 10.

The stroke of the squeeze pin 10 obtained by correcting in the above-described way, is compared with the set stroke. As a result of such comparison, if the actual stroke exists outside the range of the permitted set value, a correction in increase or decrease of at least one parameter among the flow rate Q, pressure P of the pressure oil and waiting time T from the time when molten metal is charged to the time when the squeeze pin 10 starts to advance, is performed in order to bring the stroke of the squeeze pin 10 close to the permitted set value. For example, in the case where the stroke of the squeeze pin 10 is short and the pressing-in is insufficient, it is necessary to increase the stroke. In such a case, with regard to the pressure P and the flow rate Q, correction by increasing such values is made. As for the waiting time T, the time when the squeeze pin 10 starts to advance is accelerated to increase the stroke of the squeeze pin 10 by subtracting an amount of correction $\delta T$.

In this way, since, in the next casting cycle, the stroke of the squeeze pin 10 is corrected so that it approaches to the set value, it is corrected toward an optimum value by the learning as the casting cycles are repeated.

However, depending on the situation, there exists a case where, even if the parameters such as the flow rate Q, pressure P and waiting time T are corrected, such a corrected input value is a limited value or the capacity of correction thereof is exceeded and, consequently, the correction becomes impossible.

In order to cope with such case, taking the technical effects as described above into consideration, the preference order of the three parameters is previously determined so that it becomes optimum to the die casting products which are scheduled to produce, whereby in the case where correction is impossible with the parameter which takes precedence as the first, the parameter which exists in the second of the preference order is corrected, and in the case where correction is further impossible with the second parameter, the parameter which exists in the third of the preference order is corrected. In this way, the parameter which is an object of correction is automatically switched in order.

Figure 4:
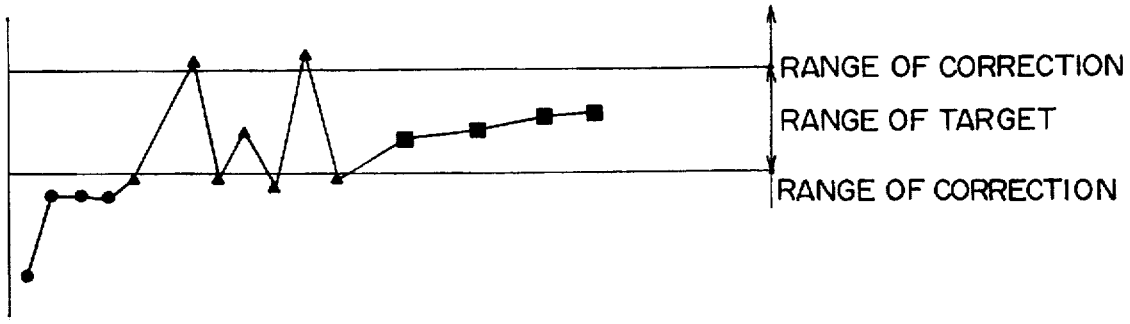
FIG. 4 is an explanative view showing an example in which each of the parameters such as the pressure and flow rate of a pressure oil supplied to a squeeze pin cylinder and a waiting time from the time when a charge of the molten metal is completed to the time when the squeeze pin starts to advance is corrected according to a precedence order.

For example, FIG. 4 shows an example in which the first of the preference order of the parameters is set to the flow rate Q, the second of the preference order set to the waiting time T and the third set to the pressure P. In FIG. 4, the plots with dark circles show the case where the correction of the flow rate is preformed at every shot, the plots with dark triangles show the case where the correction of the waiting time is made, and the plots with dark squares show the case where the correction of the pressure is made.

In the case of this example, since the stroke of the detected stroke of the squeeze pin does not reach a range of the target, the correction by increasing the flow rate Q which is the first of the preference order is first performed up to the maximum flow rate so that the stroke exists within the range of the target, however, it does not reach the range of the target yet, showing the fact that correction is impossible only with the correction of the flow rate Q (limit of correction).

In that case, the first of the preference order is switched to carry out the correction of the waiting time which exists in the second of the preference order. FIG. 4 shows the fact that as a result of the correction of the waiting time, great amplitudes are repeated in the detected strokes and, consequently, becomes unstable, with the result that the frequency of correction has exceeded the times of management.

Accordingly, it is automatically switched to the correction of the pressure which exists in the third of the preference order, thus showing the fact that the stroke exists within the range of the target and becomes stable.

In this way, in the case where the limit of correction is exceeded, or the scatter of the detected stroke value is great and the times of the frequency of correction exceeds the times of management, the preference order of each parameter such as the flow rate Q, waiting time T and pressure P is changed and correction is made, for example, in the order of the pressure P, flow rate Q and waiting time T, thereby allowing the stroke of movement of the squeeze pin 10 to be controlled so that it positively exists within the range of the target.

As described above, according to the invention, the flow rate detector for detecting the stroke of the squeeze pin exists on the back pressure side of the squeeze pin cylinder and, consequently, the measurement of the flow rate is performed on the return side under no pressure to the tank, thereby eliminating any error in the detection of the flow rate arising from expansion of the hose, contraction of air mixed into the pipe line and the like, making the precise detection of the stroke of the squeeze pin possible and allowing the accuracy of the stroke control of the squeeze pin to be enhanced.

Further, according to the invention, since an amount of leakage which leaks from the squeeze pin cylinder is detected and the detected stroke of the squeeze pin is corrected according to such amount of leakage, an amount of the inner leakage which occurs actually at the time of the squeezing motion of the squeeze pin cylinder is included in the detected value, thereby allowing the actual stroke of movement of the squeeze pin to be detected more strictly.

Moreover, according to the invention, the preference order of the control parameters comprising the pressure and flow rate of the molten metal supplied to the squeeze pin cylinder and the waiting time from the time when a charge of the molten metal is completed to the time when the squeeze pin starts to advance is set, and each of the parameters is automatically corrected in order according to the set preference order until the stroke of the squeeze pin comes to a target value and, accordingly, even if the input value of a certain parameter is a limited value or exceeds a capacity of correction, the correction of other parameters allows the stroke of the squeeze pin to be controlled positively within an appropriate range.

What is claimed is:

1. A die casting machine comprising a device for controlling a squeeze pin, in which molten metal charged into a cavity of a metal mold is locally pressurized by said squeeze pin, which comprises:

a squeeze pin cylinder for driving said squeeze pin;

a squeeze pin hydraulic controlling circuit which is connected to said squeeze pin cylinder and which controls the pressure and flow rate of pressure oil supplied to said squeeze pin cylinder; and a flow rate detector which is connected to the back pressure side of said squeeze pin cylinder and which detects the flow rate of pressure oil supplied to said squeeze pin cylinder.

2. A method of controlling at least one squeeze pin in a die casting machine, in which molten metal charged into a cavity of a metal mold is locally pressurized by said squeeze pin, which comprises:

detecting a flow rate of pressure oil at the back pressure side of said squeeze pin cylinder for driving said squeeze pin;

calculating a stroke of said squeeze pin on the basis of said detected flow rate; and controlling the stroke of said squeeze pin to a target value with said detected flow rate as a parameter.

3. A method according to claim 2, further comprising detecting an amount of leakage of said pressure oil in said squeeze pin cylinder, subtracting said amount of leakage of said pressure oil from said detected flow rate, and wherein the step of calculating the stroke of said squeeze pin comprises calculating on the basis of the flow rate after said amount of leakage is subtracted.

4. A method of controlling said squeeze pin as claimed in claim 2, further comprising:

adding, to said flow rate, a pressure of the oil pressure supplied to said squeeze pin cylinder and a waiting time from the time when a charge of molten metal is completed to the time when said squeeze pin starts to advance, as each of the parameters which control the stroke of said squeeze pin toward a target value, setting a preference order of each of said parameters which comprises said flow rate, pressure and waiting time, and correcting said each of the parameters in order according to said preference order until the stroke of said squeeze pin comes to a target value.

* * * * *